US007624911B2

(12) United States Patent
Spurrell et al.

(10) Patent No.: US 7,624,911 B2
(45) Date of Patent: Dec. 1, 2009

(54) CONTAINER WITH FREESTANDING INSULATING ENCAPSULATED CELLULOSE-BASED SUBSTRATE

(75) Inventors: Robert M Spurrell, Kent, WA (US); Michael J Smith, Sammamish, WA (US)

(73) Assignee: International Paper Co., Memphis, TN (US)

( * ) Notice: Subject to any disclaimer, the term of this patent is extended or adjusted under 35 U.S.C. 154(b) by 161 days.

(21) Appl. No.: 11/172,202

(22) Filed: Jun. 29, 2005

(65) Prior Publication Data

US 2007/0000983 A1 Jan. 4, 2007

(51) Int. Cl.
*B65D 5/50* (2006.01)
*B65D 5/56* (2006.01)

(52) U.S. Cl. ..... 229/103.11; 229/122.32; 229/939

(58) Field of Classification Search ..... 229/103.11, 229/122.32, 122.33, 939; 220/592.2, 592.21, 220/592.23, 592.25, 592.26
See application file for complete search history.

(56) References Cited

U.S. PATENT DOCUMENTS 1,843,038 A * 1/1932 McIlvain ..... 62/60
1,865,688 A * 7/1932 Hannaford ..... 62/371
1,890,771 A * 12/1932 Drummond ..... 62/372
1,930,680 A * 10/1933 Hinton ..... 229/120
2,528,715 A * 11/1950 Wagner ..... 62/165
3,406,052 A 10/1968 Peters
3,864,200 A 2/1975 Marshall
3,929,536 A 12/1975 Maughan
3,945,558 A * 3/1976 Elder ..... 229/109
3,957,195 A * 5/1976 Lin ..... 229/122.33
4,087,300 A 5/1978 Adler
4,540,392 A 9/1985 Junod et al.
4,551,123 A 11/1985 Inagaki
4,722,474 A 2/1988 Dropsy
4,749,430 A 6/1988 Samuelson et al.
4,806,398 A 2/1989 Martin, Jr.
4,850,506 A * 7/1989 Heaps et al. ..... 229/122.32
4,871,406 A 10/1989 Griffith
5,009,308 A 4/1991 Cullen et al.
5,108,355 A 4/1992 Walsh
5,133,999 A 7/1992 Löfgren et al.
5,145,549 A 9/1992 Mosburger
5,176,251 A 1/1993 Davis et al.
5,201,868 A * 4/1993 Johnson ..... 229/103.11
5,240,111 A 8/1993 Yamashita et al.
5,316,609 A 5/1994 Guither et al.
5,348,186 A * 9/1994 Baker ..... 229/122.33
5,429,264 A * 7/1995 Hollander et al. ..... 229/103.11
5,575,418 A 11/1996 Wu et al.
5,580,922 A 12/1996 Park
5,609,293 A 3/1997 Wu et al.

(Continued)

FOREIGN PATENT DOCUMENTS

WO WO 90/09927 A1 9/1990

(Continued)

*Primary Examiner*—Gary E Elkins
(74) *Attorney, Agent, or Firm*—Matthew M. Eslami

(57) ABSTRACT

An insulating container to replace expanded polystyrene includes a freestanding, cellulose-based substrate encapsulated with a polymeric film. The encapsulated cellulose-based substrate may be provided with an insulating value to match that of expanded polystyrene. Additionally, the encapsulated cellulose-based substrate may be recycled in the OCC recycle stream.

7 Claims, 17 Drawing Sheets

U.S. PATENT DOCUMENTS

| | | | | |
|---|---|---|---|---|
| 5,632,404 | A | 5/1997 | Walsh | |
| 5,651,851 | A | 7/1997 | Gatcomb | |
| 5,690,775 | A | 11/1997 | Calvert et al. | |
| 5,710,434 | A | 1/1998 | Park | |
| 5,725,917 | A | 3/1998 | Parks | |
| 5,746,871 | A | 5/1998 | Walsh | |
| 5,783,030 | A | 7/1998 | Walsh | |
| 5,792,301 | A | 8/1998 | Calvert et al. | |
| 5,794,812 | A | 8/1998 | Walsh | |
| 5,830,320 | A | 11/1998 | Park | |
| 5,968,636 | A | 10/1999 | Sinclair et al. | |
| 5,988,494 | A | 11/1999 | Fontaine | |
| 6,113,981 | A | 9/2000 | Ogilvie, Jr. et al. | |
| 6,221,192 | B1 | 4/2001 | Walsh | |
| 6,332,488 | B1 | 12/2001 | Walsh | |
| 6,338,234 | B1 | 1/2002 | Muise et al. | |
| 6,352,096 | B1 | 3/2002 | Walsh | |
| 6,358,558 | B1 | 3/2002 | Viitanen | |
| 6,450,398 | B1 * | 9/2002 | Muise et al. | 229/5.84 |
| 6,632,163 | B2 | 10/2003 | Zumbiel | |
| 2001/0022211 | A1 | 9/2001 | Walsh | |
| 2002/0000297 | A1 | 1/2002 | Kitano et al. | |

FOREIGN PATENT DOCUMENTS

| | | | |
|---|---|---|---|
| WO | WO 94/02364 | A1 | 2/1994 |

* cited by examiner

CONTAINER WITH FREESTANDING INSULATING ENCAPSULATED CELLULOSE-BASED SUBSTRATE

FIELD OF THE INVENTION

The present invention relates to insulating hot and cold products with a cellulose-based substrate encapsulated with a polymeric film.

BACKGROUND OF THE INVENTION

Containers made from or utilizing expanded polystyrene or other expanded polymers as an insulating medium have been in use for many years. Polystyrene is considered a suitable insulating material for many applications. However, its wide acceptance has made polystyrene a nuisance to dispose of because of the difficulty of disposing in an environmental responsible manner. Polystyrene is generally not as easily recyclable by consumers compared with, for example, OCC (old corrugated cardboard). Most cities now have recycling programs that will pick up consumer's OCC and other recyclables, such as glass, directly from a consumer's home. However, many of these programs exclude expanded polystyrene. If the consumer wishes to recycle expanded polystyrene, the consumer must usually have to travel a long distance in order to dispose of their expanded polystyrene. The sorting of expanded polystyrene from recyclables produces much waste in terms of hours spent in sorting, and hauling away expanded polystyrene. Also, if the expanded polystyrene is not recycled, it will most likely end in a landfill, where its expanded volume takes up considerable amount of landfill space. The properties that make expanded polystyrene a good insulating material include being lightweight, being water resistant, having a high insulating value, and being generally inexpensive to manufacture. However, expanded polystyrene also has certain drawbacks, such as being fragile.

Containers made from fibreboard, which is a cellulose-based product, are widely used in many applications as well. However, to date, containers made from fibreboard have not been specifically desirable as insulating materials. This was partly due to the fact that if fibreboard becomes wet, fibreboard will lose its strength and is prone to tearing. While many attempts have been implemented for sealing fibreboard containers from moisture penetration, the methods that were tried proved to be less than satisfactory.

In U.S. application Ser. Nos. 10/879,846; 10/880,008; 10/879,268; and 10/879,821, the assignee of the present invention described methods for producing a cellulose-based substrate encapsulated with a polymeric film that is recyclable and moisture resistant.

However, there is still a need for products that may replace expanded polystyrene, for example, and methods to develop encapsulated cellulose-based substrates into suitable replacements for many applications now using expanded polystyrene. The present invention solves this problem and has further related advantages.

SUMMARY OF THE INVENTION

All manner of temperature sensitive products, including food, such as vegetables, fruit, fish, beef, poultry, dairy, are normally transported in refrigerated vehicles usually in containers that have thermal insulation to lessen the growth of spoilage bacteria, and to keep the product fresh, once removed from the refrigerated vehicle. In many applications, expanded polystyrene is the material of choice to use as thermal insulation. However, the disadvantages of expanded polystyrene are soon felt when the grocery store that receives the insulated food is not serviced by a local expanded polystyrene recycling center. Since most cities regularly recycle OCC, the grocery store would find it convenient to be able to recycle insulating containers in the OCC recycle stream. Unfortunately for many grocers, expanded polystyrene cannot be placed with the OCC recycle stream.

Cellulose-based substrates that have been encapsulated with a polymeric film are generally not prohibited from the OCC recycle stream. Furthermore, some encapsulated cellulose-based substrates have been found to be good insulators, and may be used in containers to provide thermal insulation that may replace containers made from expanded polystyrene.

In one aspect, one embodiment of the present invention is directed to a container. In this embodiment, the container has an exterior container body. The container has an insulating member in the interior of the container body, wherein the insulating member includes a cellulose-based substrate encapsulated with a polymeric film. The insulating member may be unattached to the container, so the insulating member is not there to provide structural support or rigidity to the container. Any structural support or rigidity provided by the insulating member is incidental. The insulating member is provided to insulate a temperature sensitive product against heat transfer both in or out of the container. To that end, the insulating member may be chosen for the particular application taking into consideration the temperature of the product, the temperature conditions to which the container holding the product may be exposed, and the insulating value required to achieve a desired insulating result. The insulating member may be a sheet, wrapping, U-board, shell, and the like, that may surround a temperature sensitive product. Any number of insulating members may be included in a container. Additionally, the insulating member may be varied in thickness, flute size, flute spacing, type of corrugating medium and in other ways to either increase or decrease the insulating capacity of the insulating member to match the desired service.

In another aspect, a set of blanks is provided to form into a thermally insulating container. In this aspect, the set includes at least one blank that may be formed into a container, and one blank that may be formed into a freestanding, insulating member for the container. At least the insulating member is provided with a cellulose-based substrate that is encapsulated with a polymeric film. Because the insulating member is freestanding, the insulating member may be provided in any orientation within the container. The insulating member may be provided on any side of the container, between layers of product, on the top, bottom, or any side of a product, as well as wrapped around a product, for example.

In another aspect, one embodiment of the present invention is directed to a method for insulating a temperature sensitive product with an encapsulated cellulose-based substrate. In this aspect of the present invention, the encapsulated cellulose-based substrate forms at least a thermally insulating layer surrounding the temperature sensitive product. An encapsulated cellulose-based substrate is a cellulose-based substrate that is sealed within a polymeric film, such that the cellulose-based substrate is substantially hermetically sealed, and/or substantially moisture resistant.

In another aspect, one embodiment is related to thermal insulation that includes a cellulose-based substrate encapsulated with a polymeric film.

Containers having insulating members made from a cellulose-based substrate encapsulated with a polymeric film may replace expanded polystyrene containers in insulating applications.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
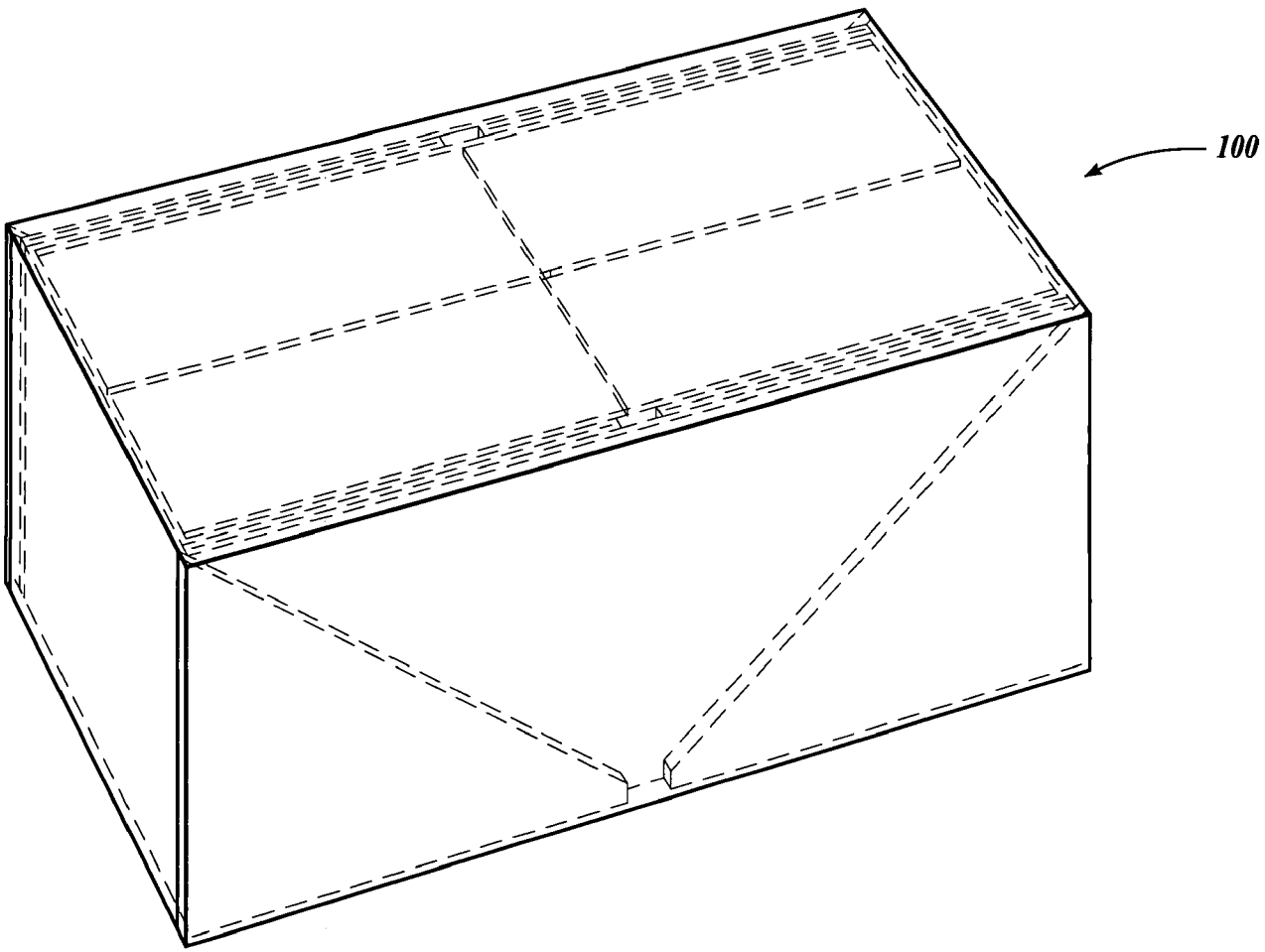
FIG. 1 is an illustration of a thermally insulating container encapsulated with a polymeric film in accordance with the present invention.

Referring to FIG. 1, a non-limiting example of a container 100 having an insulating member made from a cellulose-based substrate encapsulated with a polymeric film is illustrated.

Cellulose-based substrates are formed from cellulose materials, such as wood pulp, straw, cotton, bagasse, and the like. Cellulose-based substrates useful in the present invention come in many forms, such as fibreboard, containerboard, corrugated containerboard, corrugated cardboard, and paperboard. The cellulose-based substrates can be formed into structures such as container blanks, inserts, tie sheets, slip sheets, and inner packings for containers. Non-limiting examples of containers made from encapsulated cellulose-based substrates include boxes, cylinders, and envelopes. Examples of inner packings include shells, inserts, wrap, tubes, partitions, U-boards, and H-dividers.

Containerboard is one example of a cellulose-based substrate useful in the present invention. Particular examples of containerboard include single face corrugated fibreboard, single-wall corrugated fibreboard, double-wall corrugated fibreboard, triple-wall corrugated fibreboard and corrugated fibreboard with more walls. The foregoing are examples of cellulose-based substrates and forms the cellulose-based substrates may take that are useful in accordance with the products and methods of the present invention; however, the present invention is not limited to the foregoing forms of cellulose-based substrates.

A container having a cellulose-based substrate encapsulated with a polymeric film provides suitable thermal insulation that may be used to replace containers made from Styrofoam, and other expanded polymers.

The six sided container of FIG. 1 may be used for enclosing a temperature sensitive object. The temperature sensitive object may be insulated against heat transfer into or out from the container depending on whether the product is hot or cold in relation to the ambient environment. For cold objects, the insulating container in accordance with the invention insulates the object against heat gain. For hot objects, the temperature insulating container in accordance with the invention insulates the object from heat loss. For discussion purposes, the insulating container will be described as a box, however, it is to be appreciated that the insulating container can take other shapes such as round, cylindrical, flat envelope, or irregularly shaped. Furthermore, the insulating container according to the present invention, may be used in consumer articles, such as, but not limited to ice chest coolers, hot and cold drink containers, pizza boxes, and the like.

The insulating container according to the present invention includes at least one insulating member within the container. The insulating member has at least a cellulose-based substrate encapsulated with a polymeric film. The insulating member may surround one, two, three, four, five, or all six sides of the container, assuming the container is a box. More than one insulating member may be located on any one side of the six sided container. It is to be appreciated that a six sided rectangular container is merely one exemplary embodiment of the invention. The insulating member preferably surrounds, at least, a portion of the object that is to be insulated against heat transfer. It is to be appreciated that one form of an insulating member is described with reference to the FIGURES, however, the insulating member is not limited to sheets having multiple panels. The insulating member in accordance with one embodiment of the invention may have a single panel, and may partially cover or surround an object. Furthermore, the insulating member in accordance with one embodiment of the invention, may not provide any substantial support for the container or the object within the container. The insulating member may be a freestanding member that is unattached to the exterior container so that the insulating member may be provided on any side of the container, between layers of product, on the top, bottom, or any side of a product, as well as wrapped around a product, for example.

Figure 2:
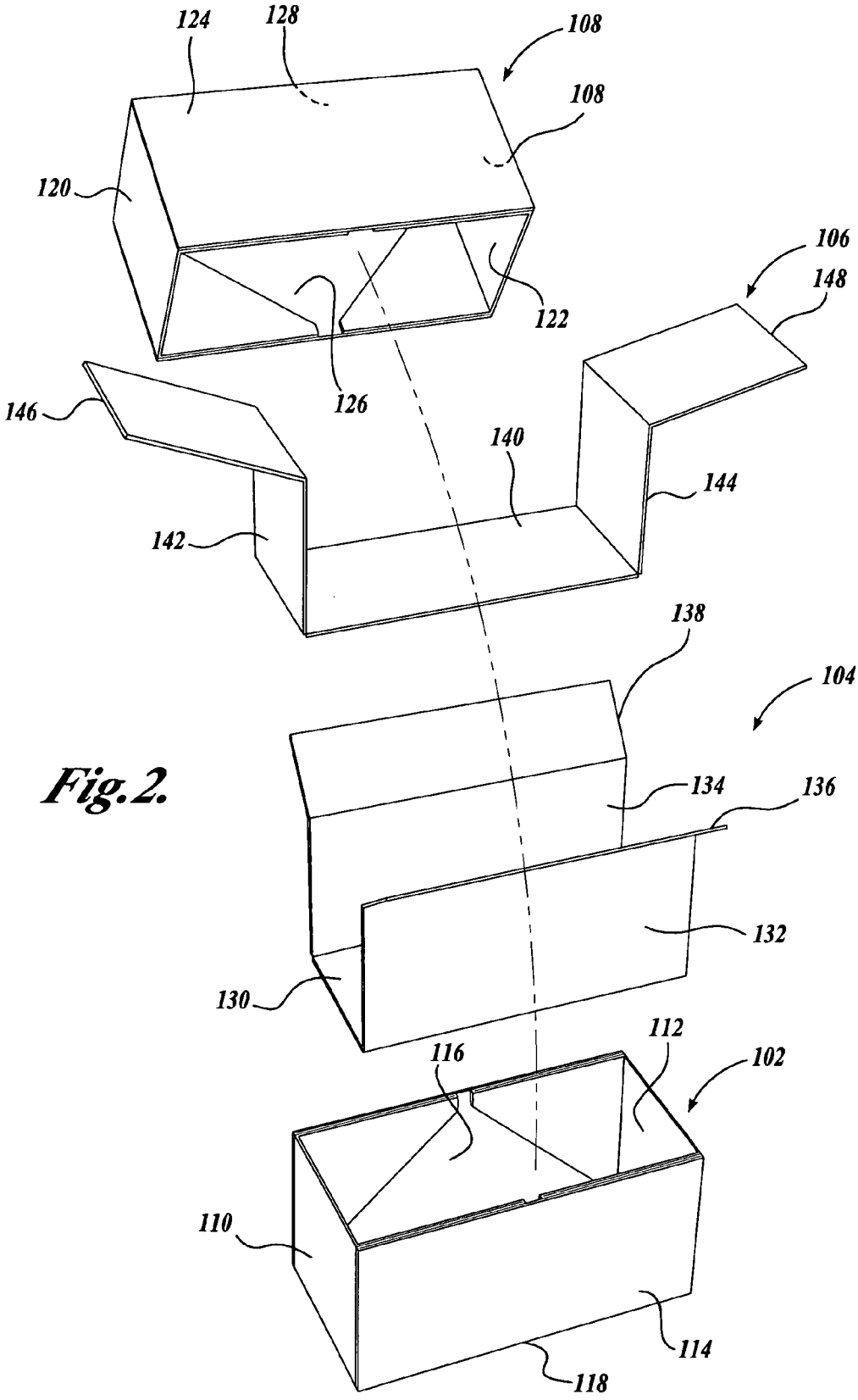
FIG. 2 is an exploded view illustration of the container of FIG. 1.

Referring now to FIG. 2, an exploded view of the insulating container 100 of FIG. 1 is illustrated. The insulating container 100 includes four components, a bottom 102, a first insert 104, a second insert 106, and a lid 108. All four of the bottom 102, the first insert 104, the second insert 106, and the lid 108 may be encapsulated with a polymeric film, or only a single component may be encapsulated. Preferably, the first 104 and the second 106 inserts are encapsulated with a polymeric film. Preferably also, the first insert 104 and the second insert 106 have a double-walled corrugate construct. Although the first and second inserts may be designed specifically as insulating members, any one of the bottom 102, the first insert 104, the second insert 106, or the lid 108, being encapsulated with a polymeric film may provide some amount of insulating value to the container 100. The bottom 102 of the box, and the lid 108 of the box may or may not be encapsulated, depending on the application. Generally, if more insulating value is desired, the more of the box components that can be encapsulated, or the more inserts that can be added, or the cellulose-based substrate can be multi-walled. Additionally, any corrugate may use A-flute, B-flute, and C-flute corrugated medium.

The bottom 102 of the container is an open, five sided structure that has two side panels 110, 112, a front panel 114 and back panel 116, and a bottom panel 118. Each of the panels may be distinct and attached to make the bottom 102 of the container. Alternatively, any two or more of the panels may be made from a unitary substrate and joined to the other panels. Preferably, all five panels may be joined, and may be provided initially as a flat blank, further discussed below. It is to be appreciated that spatial descriptions used throughout this application are made with reference to the FIGURES, and are not meant to be limiting of the invention.

The lid 108 of the box is an open, five sided structure that has two side panels 120, 122, a front panel 124 and back panel 126, and a top panel 128. The lid 108 of the container forms an opening to allow mating with the bottom 102 of the container. Each of the panels may be distinct and attached to make the lid 108 of the container. Alternatively, any two or more of the panels may be made from a unitary substrate and joined to the other panels. Preferably, all five panels may be joined, and may be provided initially as a flat blank.

The first insert 104 is a five paneled structure that is sized to fit within the bottom 102 of the container. When folded, the first insert 104 has dimensions slightly smaller than the interior dimensions of the bottom 102 of the container to fit therein. It is to be appreciated that the first insert 104 is designed to provide insulating value, and incidentally may provide structural support. Other embodiments of insulating members may provide no structural support, either to the container or the object, such as an insulating member that is simply wrapped around an object to insulate the object from heat transfer. The first insert 104 has a bottom panel 130 that may be slightly smaller than the bottom panel 118 of the bottom 102 of the container. The first insert 104 has a front 132 and back 134 panel that may be slightly smaller than the front 114 and back 116 panels of the bottom 102 of the container. The first insert 104 has a first top 136 panel and a second top 138 panel that may fold in or out. The top panels 136 and 138 are referred to as flaps. The flaps 136, 138 may be about half of the width dimension of the opening of the bottom 102 of the container from front to back, and may be slightly smaller in length than the front 114 or back 116 panels of the bottom 102 of the container. When the flaps 136, 138 are folded out, the container may be loaded with product. When folded in, the flaps 136, 138 cover the opening of the bottom 102 of the container. As an alternative to two top panels, 136, 138, the first insert 104 may have only a single top panel that may be slightly smaller than the opening of the bottom 102 of the container. As may be appreciated from the foregoing, the first insert 104 substantially lines the bottom panel 118, the front panel 114, the back panel 116 of the container bottom 102. Also, when the lid 108 is used to enclose the container bottom 102, the flaps 136 and 138 line the top panel 128 of the lid 108. The first insert 104 may be used alone or in combination with a second insert 106, or alternatively, the first insert 104 may be omitted, and the second insert 106 may be used alone or in combination with the first insert 104. Alternatively, both the first insert 104, and the second insert 106 may be used in combination with additional inserts (not shown), or may be omitted entirely, and/or other insulating member forms may be used. Thus, the insulation value of a container may be adjusted by adding or removing insulating members, such as, but not limited to inserts 104 and 106.

The second insert 106 is a five paneled structure that is sized to fit within the bottom 102 of the container. When folded, the second insert 106 has dimensions that may be slightly smaller than the interior dimensions of the bottom 102 of the container to fit therein. The second insert 106 has a bottom panel 140 that may be slightly smaller than the bottom panel 118 of the bottom 102 of the container. The second insert 106 has side panels 142, 144 that may be slightly smaller than the side panels 110, 112 of the bottom 102 of the container. The second insert 106 has a first top 146 panel and a second top 148 panel that may fold in or out. Panels 146 and 148 are referred to as flaps. The flaps 146, 148 may be about half of the length dimension of the opening of the bottom 102 of the container from side to side, and are slightly smaller in width than either of the side panels 110, 112, of the bottom 102 of the container. When the flaps 146, 148 are folded out, the container may be loaded with product. When folded in, the flaps 146, 148 cover the opening of the bottom 102 of the container. As an alternative to two top panels, 146, 148, the second insert 106 may have only a single top panel that may be slightly smaller than the opening of the bottom 102 of the container. If used in combination with the first insert 104, and depending on which insert is placed in the container bottom 102 first, the second insert (as shown in FIG. 2) may line the bottom panel 130 of the first insert 104, but lines the side panels 110 and 112 of the container bottom 102. Alternatively, if the second insert 106 is placed in the container bottom 102 without the first insert 104, the second insert 106 lines the bottom panel 118, and the two side panels 110, 112 of the container bottom 102. Also, when the lid 108 is used to enclose the container bottom 102, the flaps 146 and 148 line the top panel 128 of the lid 108. As can be appreciated from the foregoing, the second insert 106 lines at a minimum, the two side panels 110 and 112, of the container bottom 102. However, while the inserts 104 and 106 described herein may be used to line a plurality of panels of either the container bottom 102 or the container lid 108, any one specific configuration should not be construed as limiting, as an insert may be used to line at least one panel of either the container bottom 102 or container lid 108. The insert may preferably line substantially the entire surface area of the panel.

Additionally, it is to be appreciated that the first insert 104 and the second insert 106 provide only exemplary embodiments of insulating members in accordance with the invention, and should not be construed as limiting the insulating member to any one specific form. The insulating member preferably is adjusted and/or designed to provide the desired amount of insulating value taking into account, for example, the expected length, temperatures, product type, and other variables. The insulating member may be corrugated or non-corrugated, may have any number of linerboards, any type of flute size, any number of walls, and any type of corrugated medium, for example. The insulating member may be designed without taking into consideration the structural requirements of the container. The insulating members of the present invention are not necessarily designed with supporting function in mind, but may be designed with the intent to insulate a hot or cold or ambient object against heat transfer.

In FIGS. 3-6, container blanks for forming into each of the bottom 102, first insert 104, second insert 106, and lid 108 components of container 100 are illustrated. The insulating container of FIG. 2 may be fabricated, and shipped disassembled as a set of any number of blanks, or individually, to the ultimate user of the container to facilitate shipping in terms of reducing the overall volume that needs to be shipped. The blanks for forming into the respective components may be provided to the user either as individual components so that the number of inserts may be adjusted as the product dictates, or as a set of blanks, so that each set may comprise a combination of four blanks for each of the respective bottom, first insert, second insert, and lid. While one embodiment is described as having four blanks for a bottom, first insert, second insert, and lid, it is to be appreciated that other combinations with more than two inserts or less than two inserts may be provided. Preferably, the container blanks will be encapsulated with a polymeric film, while still in the container blank form. However, it is possible that the container components may be encapsulated after having been folded and formed into container components. Such encapsulation may be as simple as placing the container components within a polymeric bag or wrapping, and sealing, adhering, welding, or otherwise bonding, any bag openings or open sides of the wrapping. Methods for encapsulation of cellulose-based substrates are mentioned in the aforementioned applications, and further methods are described below.

For purposes of the following description, the blanks have the same reference numerals as the container components to correlate the blank to the component.

Figure 3:
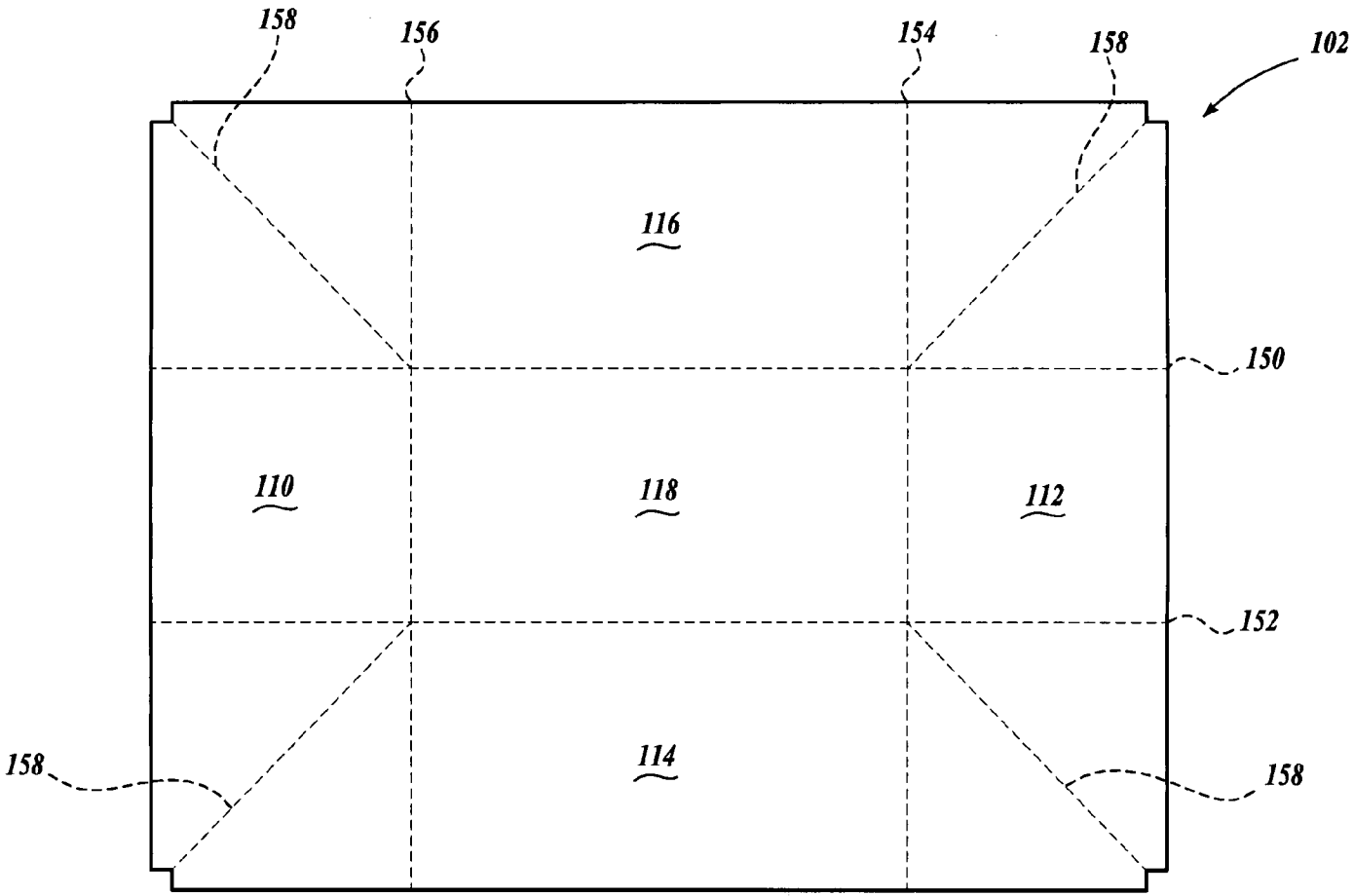
FIG. 3 is an illustration of a blank that forms the bottom of the container of FIG. 1.

Referring now to FIG. 3, a blank for a container bottom 102 is illustrated. The blank 102 includes a monolithic cellulose-based substrate generally having the shape of a four-sided rectangle. There are two small perpendicular cuts made at each corner of the blank 102 to provide for easier folding and/or bonding.

First 150 and second 152 vertical crease lines are made in the container blank 102, roughly dividing the container blank 102 into three substantially equal, vertical areas. The two outer most areas may be similar in dimension, since the two outer areas will form the standing front 114 and back 116 panels of the container bottom 102. Third 154 and fourth 156 horizontal, crease lines traverse the container blank 102 at the upper and lower portions thereof dividing the container blank 102 into substantially equal, horizontal uppermost and lowermost portions, thereby also creating a middle portion. The uppermost and lowermost portion of the container blank 102 are approximately equal in area, since these areas of the container blank 102 will form the standing part of the sides 110, 112 of the container bottom 102. Diagonal crease lines 158 are provided in the four corners of the container blank 102. Each diagonal crease line 158 connects the corner of the blank 102 to the intersection of a vertical and horizontal crease line. The diagonal crease lines 158 facilitate in folding and bonding the blank 102 into the side panels and front and back panels of the container bottom 102. The overall dimensions of one exemplary embodiment of the container blank 102 are about 39 9/16 inches in width and about 52 9/16 inches in length. The overall dimensions of the container bottom produced from such blank may be about 25⅝ inches in length, about 12⅝ inches in width, and about 13¼ inches in depth. One embodiment of the container blank 102 is made from 44 ECT C corrugate board. This is single walled board with C sized flutes.

Figure 4:
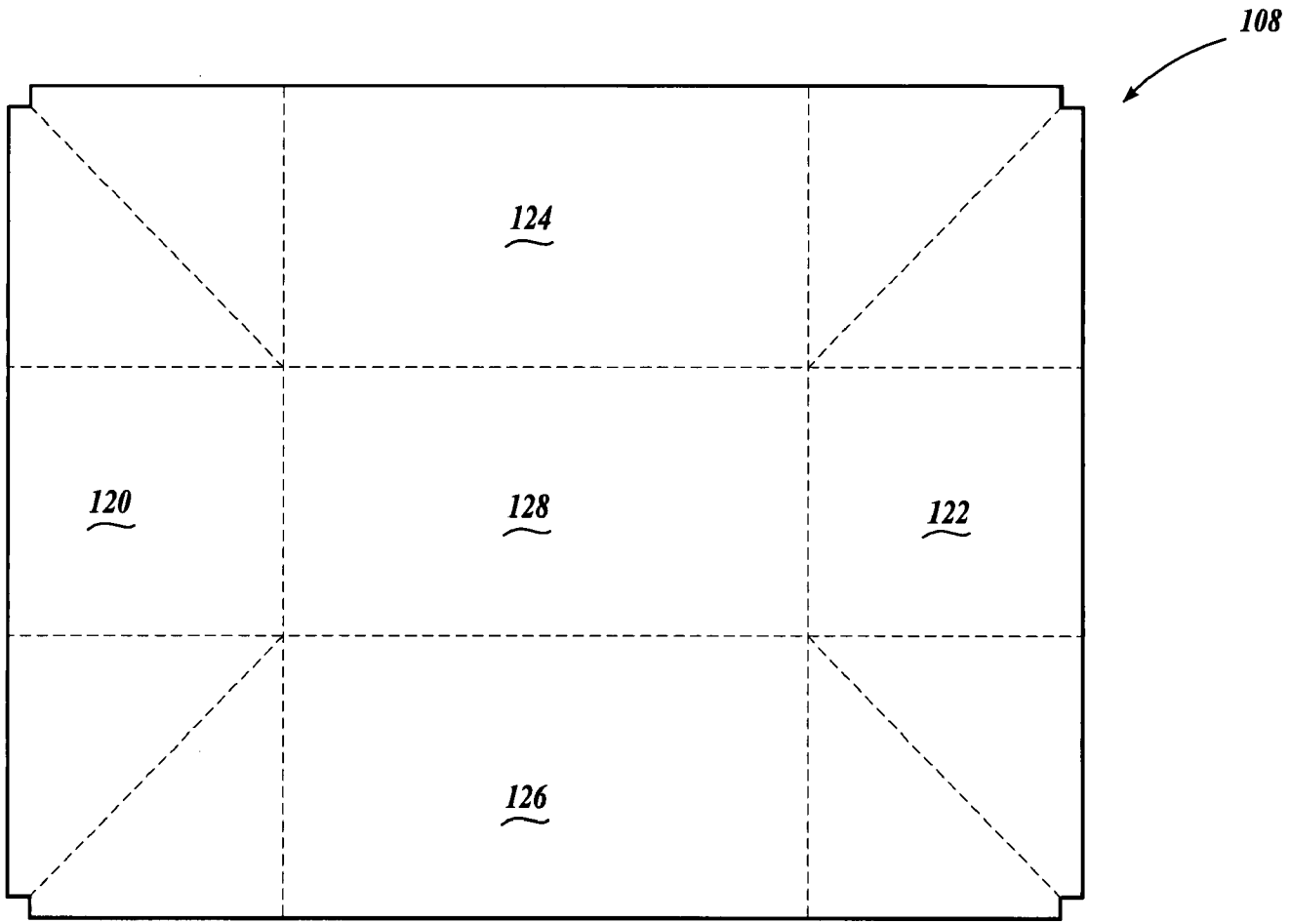
FIG. 4 is an illustration of a blank that forms the lid of the container of FIG. 1.

Referring to FIG. 4, the blank 108 for the container lid 108 is illustrated. As is readily appreciated, the container blank 108 for the container lid 108 is substantially identical to the container blank 102 for the container bottom 102. However, the blank 108 for the container lid 108 may be slightly greater in overall width and length than the blank 102 for the container bottom 102, so that when constructed, the lid 108 will be able to slide within the exterior standing walls of the container bottom 102. The overall dimensions of one embodiment of the container blank 108 are about 40⅜ inches in width and about 53⅜ inches in length. The overall dimensions of the container lid produced from such blank may be about 25⅝ inches in length, about 12⅝ inches in width, and about 13¼inches in depth. One embodiment of the container blank 108 is made from 44 ECT C corrugate board.

Figure 5:
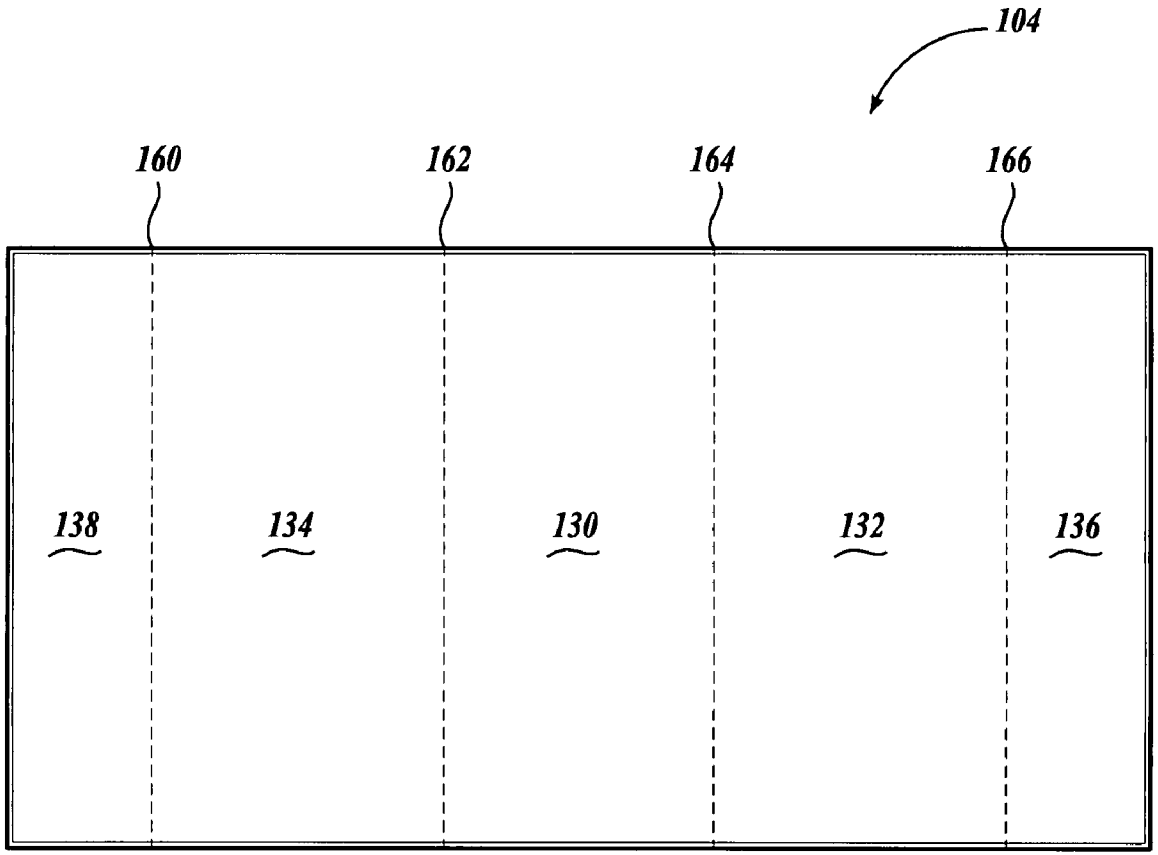
FIG. 5 is an illustration of a blank that forms the first insert of the container of FIG. 1.

Referring now to FIG. 5, the blank for the first container insert 104 is illustrated. The insert blank 104 has four parallel crease lines running vertically from the top edge to the bottom edge. The crease lines 162, 164 in the center of the blank 104 define the bottom panel 130 therebetween that may be about the same or slightly smaller than the inside dimension of the container bottom 102. The crease lines 164, 166 define a panel therebetween that may be about the same or slightly smaller in size than the standing front panel 114 of the container bottom 102. The crease lines 162, 164 define a panel therebetween that may be about the same size or slightly smaller in size than the standing back panel 116 of the container bottom 102. Crease line 160 to the respective edge of the first insert blank 104, defines the flap 136, and crease line 166 to the respective edge of the first insert blank 104 defines the flap 138. It is to be appreciated that the first insert 104 overlaps with the bottom panel 118, the front panel 114, the back 116 panel, and may cover the opening of the bottom 102 of the container. The overall dimensions of one embodiment of the container blank 104 are about 25½ inches in width and about 50⅜ inches in length. The overall dimensions of the container insert produced from such blank may be about 25 inches in length, about 11 11/16 inches in width, and about 12 inches in depth. One embodiment of the container blank 104 is made from 48 ECT BC Kraft board. This is a double walled board with B and C sized flutes.

Figure 6:
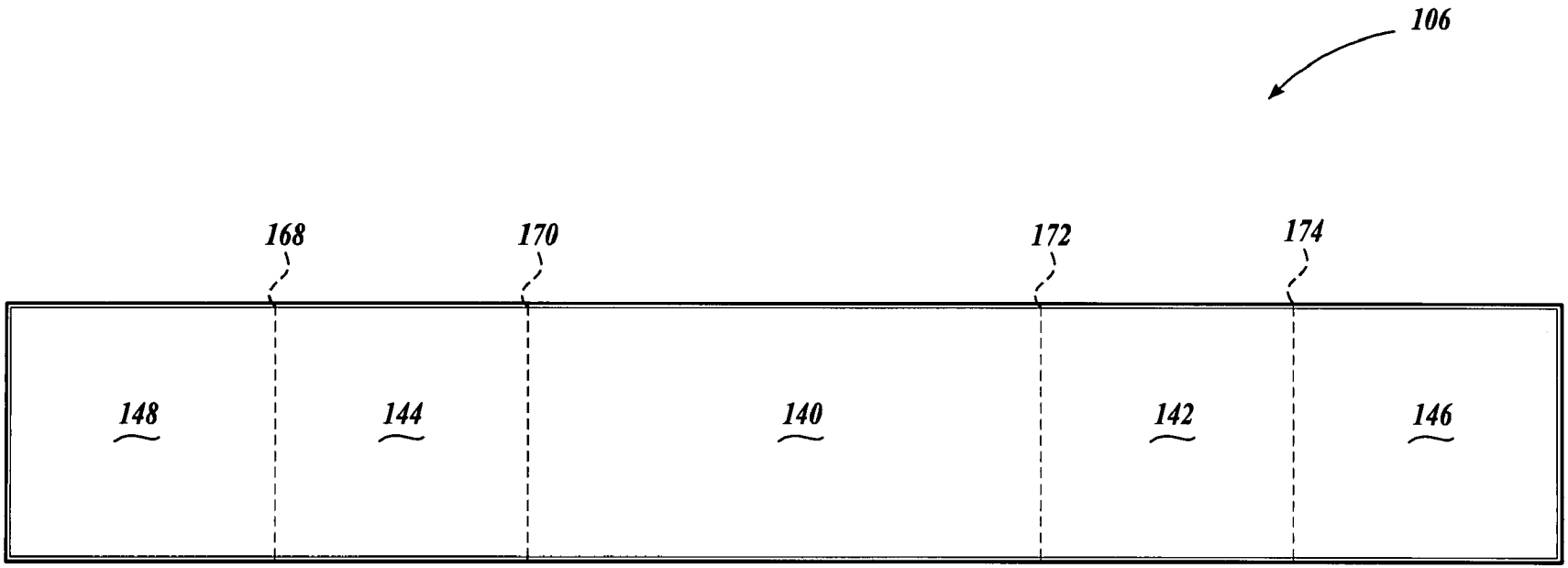
FIG. 6 is an illustration of a blank that forms the second insert of the container of FIG. 1.

Referring now to FIG. 6, the blank 106 for the second insert 106 is illustrated. The second insert 106 has four crease lines 168, 170, 172, and 174 that run horizontally. Middle horizontal lines 170, and 172 define the bottom 140 panel of insert 106 therebetween that may be about the same size or slightly smaller than the inside dimension of the container bottom 102. Crease line 168 with crease line 170 and crease line 174 with crease line 172 define the side panels 144, 142, respectively, of insert 106 therebetween. Side panels 144, 142 may be approximately the same size or slightly smaller than the inner sides of side panels 112, 110 of the bottom 102 of the container. Crease lines 168, 174 and the top and bottom edge, respectively, define the flaps 148, 146, respectively, of the insert 106 therebetween. Flaps 146, 148 may be about one-half of the area of the opening of the bottom 102 of the container. It is to be appreciated that the second insert 106 may overlap with the bottom panel 130 of the first insert 104, but may overlap with side panels 110, 112 of the container bottom 102 that are not overlapped by the first insert 104. The overall dimensions of one embodiment of the container blank 106 are about 11 15/16 inches in width and about 75¾ inches in length. The overall dimensions of the container insert produced from such blank may be about 25 inches in length, about 11 11/16 inches in width, and about 12 inches in depth. One embodiment of the container blank 106 is made from 48 ECT BC Kraft board.

Figure 7:
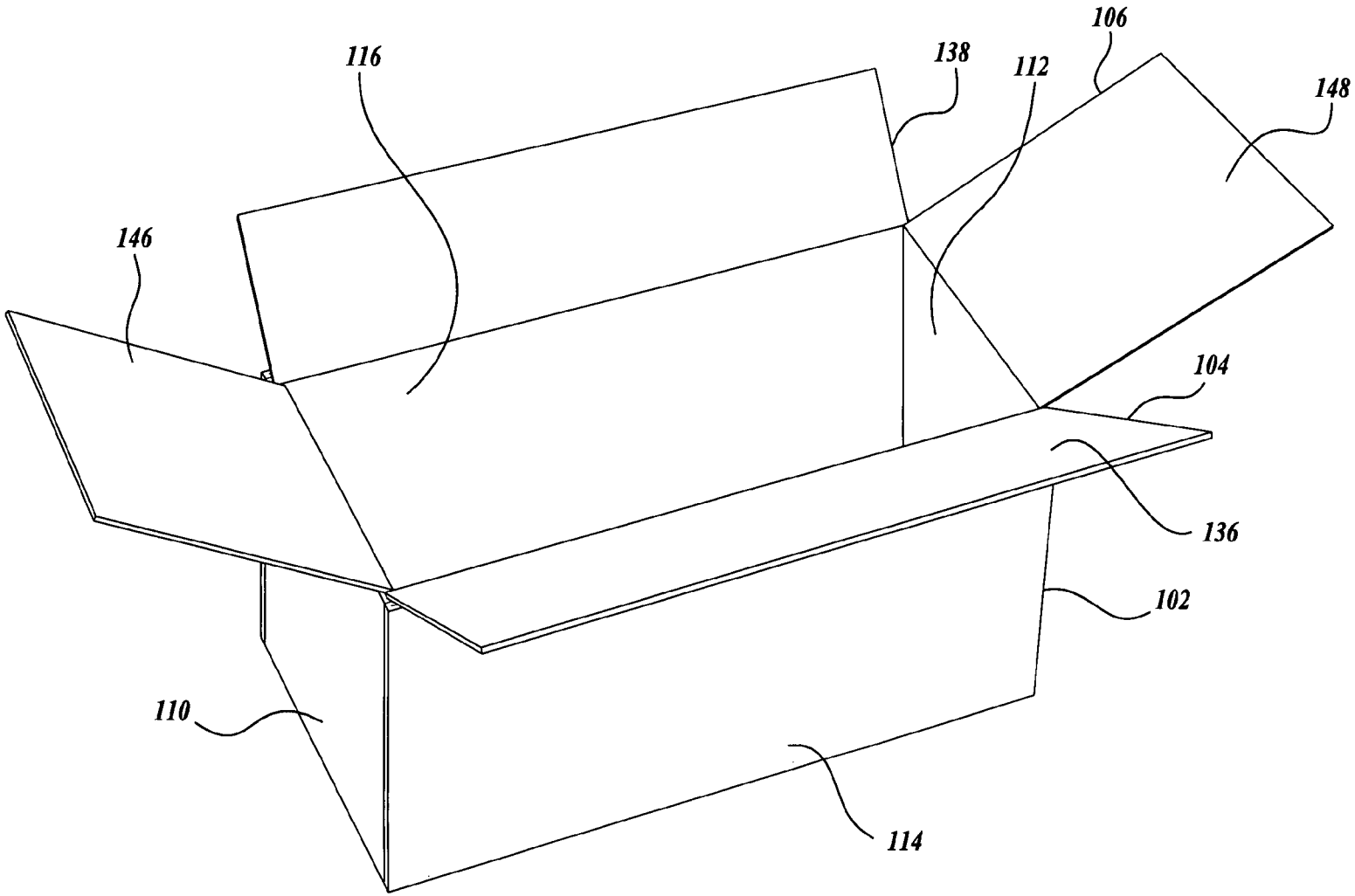
FIG. 7 is an illustration of a partially assembled container of FIG. 1.

Referring to FIG. 7, a partially assembled container is illustrated. The bottom 102 of the container has the first insert 104 placed therein so that the flaps 136, 138 of the first insert 104 project outward from the front 114 and back 116 panels of the bottom 102 of the container. The second insert 106 is placed on top of the first insert 104, and the flaps 146, 148 of the second insert 106 project outward from both sides 110, 112 of the bottom 102 of the container. Either the flaps of the first 104 or the second 106 insert may be folded inward first, followed by the flaps of the other insert. The lid is then placed over the bottom of the container.

Figure 8:
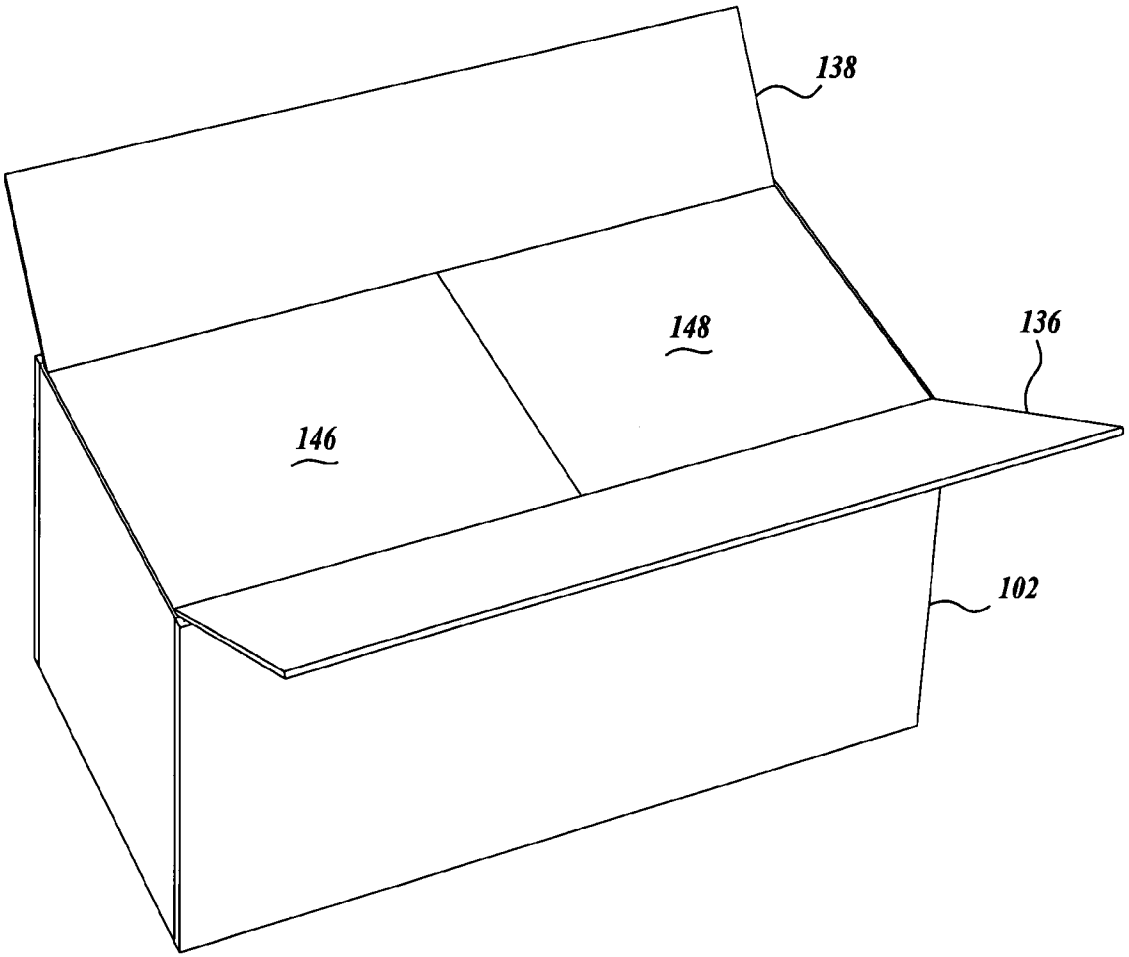
FIG. 8 is an illustration of a partially assembled container of FIG. 1.

Referring to FIG. 8, the flaps 146, 148 of the second insert 106 have been folded over the opening of the bottom 102 of the container, which will be followed by folding the flaps 136, 138 of the first insert 104 over the opening of the bottom 102 of the container.

Figure 9:
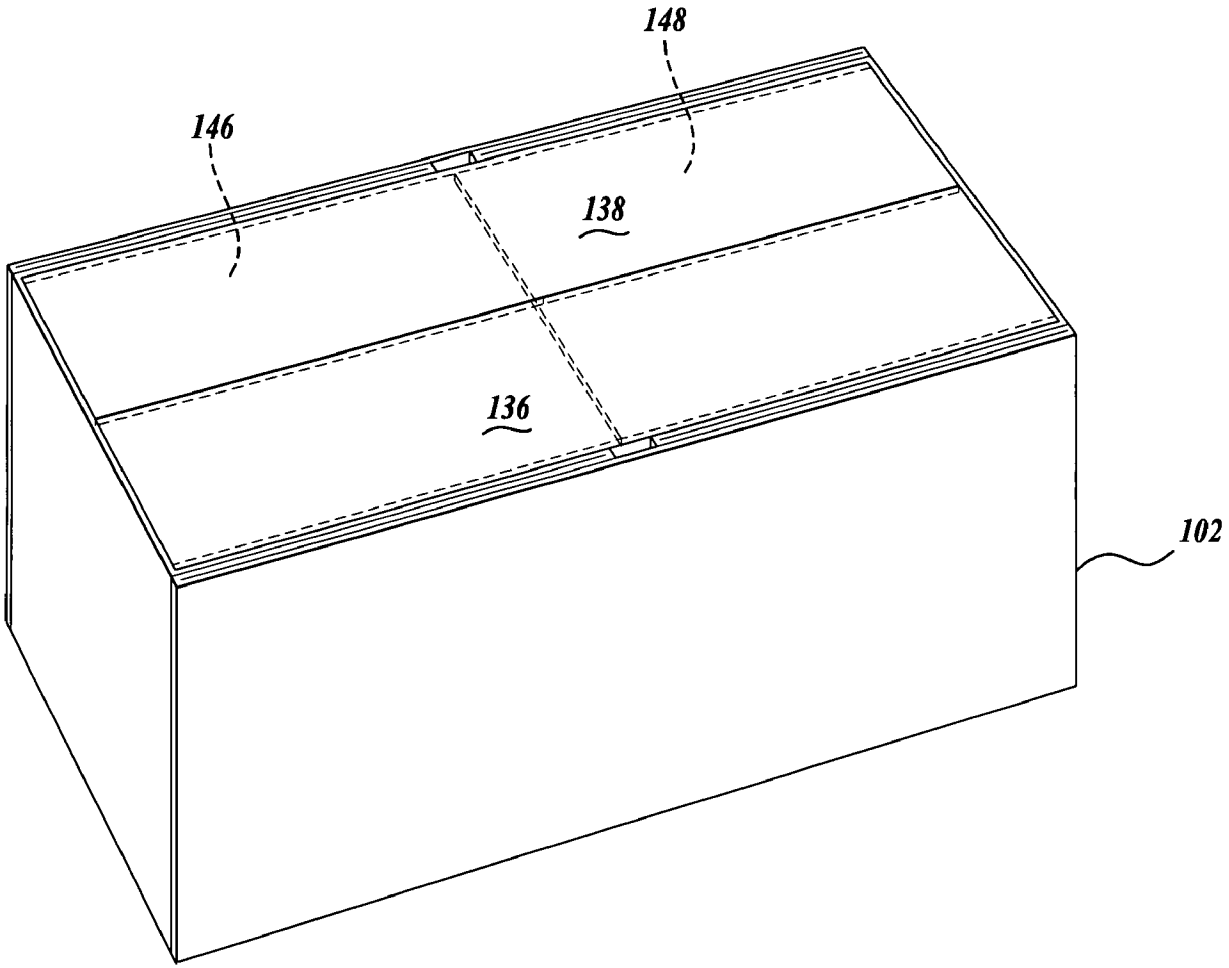
FIG. 9 is an illustration of an assembled container of FIG. 1.

Referring to FIG. 9, the flaps 136, 138 of the first insert 104 have been folded over the tops of the flaps 146, 148 of the second insert 106 (shown in phantom). The lid 108 of the container may now be placed over the bottom 102 of the container.

Figure 10:
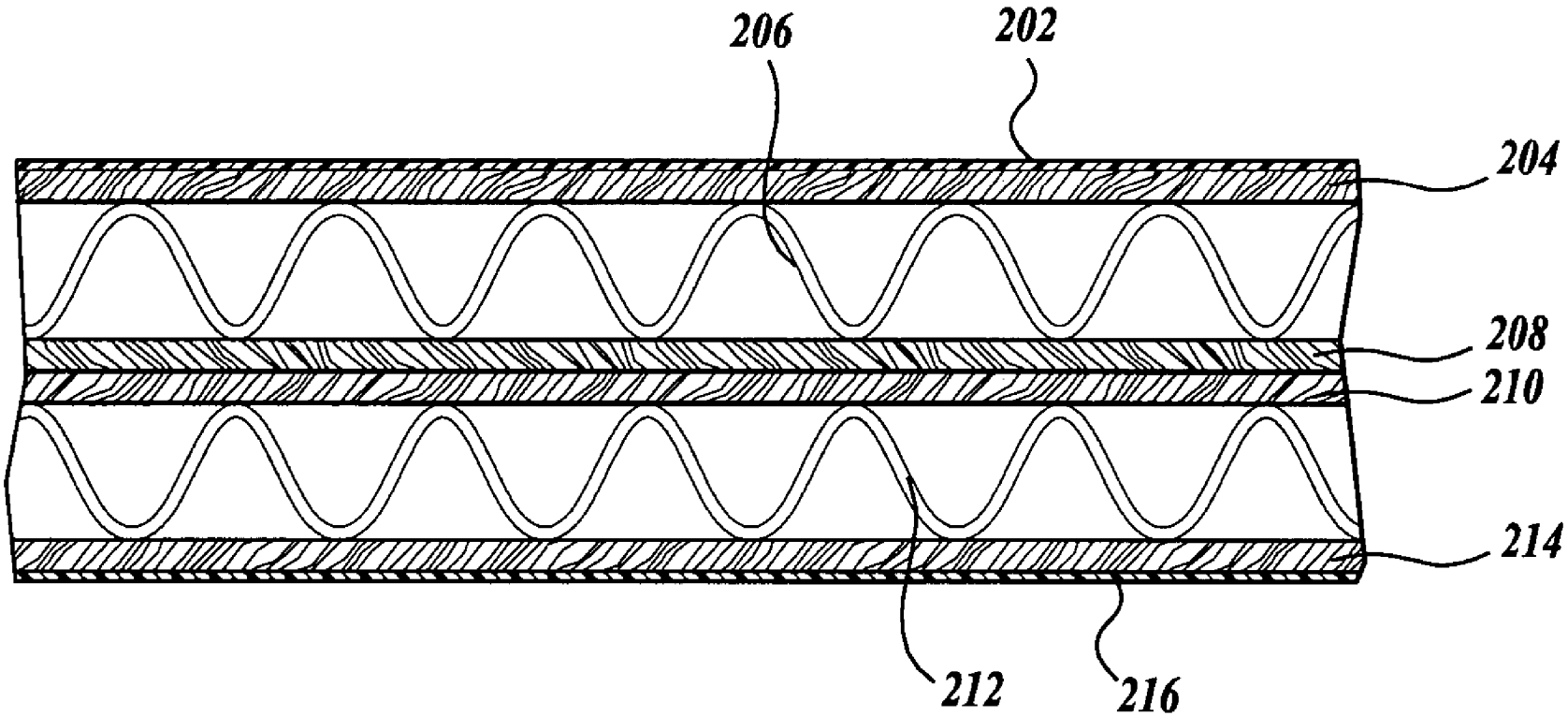
FIG. 10 is an illustration of a double walled encapsulated cellulose-based substrate useful as an insulating member.

Referring to FIG. 10, a cross-sectional illustration of one embodiment of an insulating member 200 made from a cellulose-based substrate encapsulated with a polymeric film is provided. The insulating member 200 may be representative of the construction of any one or all of the bottom 102, the first insert 104, the second insert 106, and the lid 108 of container 100. It is to be appreciated that insulating member 200 is merely a representative embodiment. Any cellulose-based substrate encapsulated with a polymeric film may function to provide some insulating value. The insulating member 200 has a double walled construct that includes two fluted spaces or corrugated medium. The greater insulating value of an encapsulated cellulose-based substrate as compared with a non-encapsulated cellulose-based substrate is partly because of the volume of air that is trapped within the corrugated medium when encapsulated. The volume of air of a two walled construct may occupy a majority of the volume of the insulating member 200. An insulating member may have, none, one or more than two corrugated media. Generally, the more corrugated media that are present in the insulating member, the greater the insulating value will be. Similarly, if the flutes are made with greater amplitude, thus increasing the width, the greater the insulating value will also be. Generally, flute dimensions are designated by the letters A, B, and C. Furthermore, it is to be appreciated that flutes merely represent one embodiment of a corrugated medium. Alternatives to flutes may be used. Such alternatives may include a structure that separates two liner boards to create an air space therebetween.

The insulating member 200 is made from a cellulose-based substrate that is encapsulated, preferably on all sides, with a polymeric film 202 to form a hermetic seal. Although one polymeric film is illustrated, it can be appreciated that the insulating member according to the invention may have more than one polymeric film on any side or surface of a cellulose-based substrate. A first liner board 204 is adjacent to the polymeric film 202. The polymeric film 202 and the first liner board 204 may be integrally bonded to one another at substantially all contact points, or may be merely adjacent to one another but not bonded to one another. Adjacent to the first liner board 204 is a corrugated medium containing mostly air by volume, which includes flutes 206 separating the first liner board 204 from a second liner board 208. Preferably, the first 204 and the second 208 liner boards are bonded to the flutes 206 on opposite sides thereof. A third liner board 210 is adjacent to the second liner board 208. The third liner board 210 may be optional. If the third liner board 210 is provided, the second 208 and third 210 liner board may or may not be bonded to one another. Preferably, the second 208 and the third 210 liner boards are bonded to each other. A second corrugated medium comprising mostly air by volume and flutes 212 is adjacent to the third liner board 210. A fourth liner board 214 is adjacent to the flutes 212. Preferably, the third liner board 210 and the fourth liner board 214 are bonded on opposite sides of the flutes 212. A second, exterior polymeric film 216 is adjacent to the fourth liner board 214, and may or may not be bonded to the fourth liner board 214. It is to be appreciated that FIG. 10 shows a portion of the insulating member 200, therefore, the sealing of the top and bottom of the portion is not shown because, it is to be appreciated that the member terminates at a different location. It is to be appreciated, however, that the polymeric film extends for the entire periphery of the member 200. Although a double walled insulating member is shown and described, it is to be appreciated that other insulating members may have only one or more than two corrugated media. Furthermore, an insulating member may have one liner board, such as a single face board. Single face board generally has one liner board and one corrugated medium. Preferably, the insulating member may have at least one corrugated medium. Furthermore, insulating members may have any number of liner boards, and any number of polymeric films. An insulating member according to the invention may be any cellulose-based substrate that is encapsulated with a polymeric film to be preferably substantially hermetically sealed and/or preferably also substantially moisture resistant. To that end, the polymeric film is preferably substantially air and water impermeable. Furthermore, it is not necessary that the insulating member provide any structural support to either the container or the product within the container.

Figure 17:
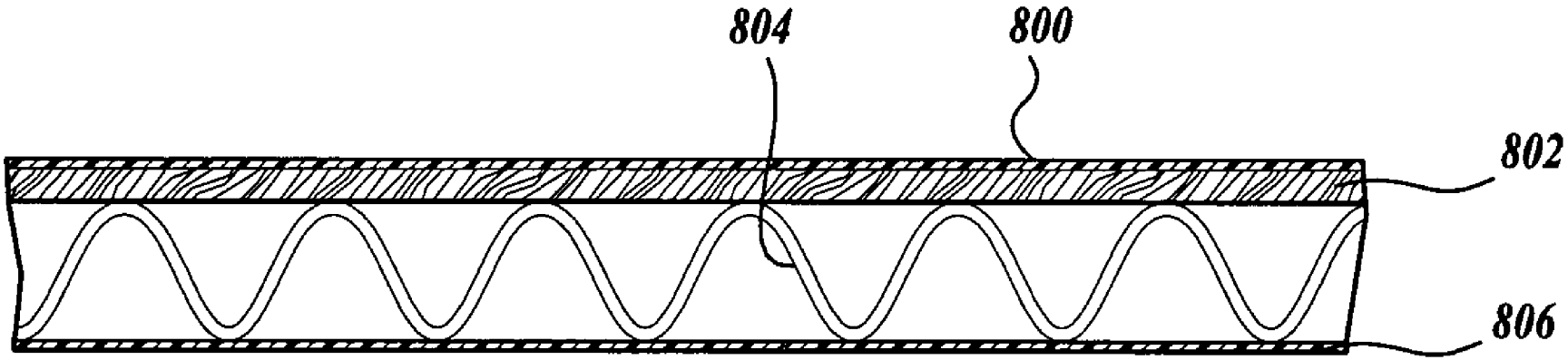
FIG. 17 is an illustration of single face encapsulated cellulose-based substrate useful as an insulating member.

FIG. 17 shows that another embodiment of an insulating member need not have a second liner board. The insulating member uses single face corrugate. The insulating member includes a liner board 802 and one corrugated medium 804 attached to the liner board on one side of the liner board 802. The liner board 802 and the corrugated medium 804 are encapsulated within a polymeric film 800, 806, on all sides thereof. It is to be appreciated that FIG. 17 shows a portion of the insulating member, therefore, the sealing of the top and bottom of the portion is not shown because, it is to be appreciated that the member terminates at a different location. It is to be appreciated, however, that the polymeric film extends for the entire periphery of the member. The insulating member of FIG. 17 is flexible, and generally more flexible in one direction than the other, and therefore, may be wrapped around the object to be insulated due to the absence of a second liner board adjacent to the corrugated medium 804.

FIG. 17 also points out another advantageous feature of one embodiment, which is that the insulating member may not be attached to the exterior container component in order to realize the insulating benefits. It may be envisioned that a sheet of the insulating member of FIG. 17 may be used to surround an object to be insulated, such as in a cylinder like fashion. Insulating members, therefore, may be freestanding within the overall container. Freestanding means that an insulating member may be unattached to any container structure that may form an exterior side or supporting structure of the container. Examples of freestanding insulating members may include a single face substrate surrounding an object, or a sheet of any cellulose-based substrate that is placed within the container to surround or partially or fully surround an object on any or all sides or portions thereof. The sheet may be placed horizontally or vertically in the container at any height or at any distance from the front, back or sides of the container. The insulating member may be provided on any side of the container, between layers of product, on the top, bottom, or any side of a product, as well as wrapped around a product, for example.

One of the advantages of an encapsulated cellulose-based substrate having a corrugated medium comprising mostly air is the insulating advantage that can be achieved. Furthermore, not only do the encapsulated cellulose-based substrates provide beneficial insulating properties, but also provide moisture resistance and the recyclable quality that is lacking in expanded polystyrene. Therefore, containers having an insulating member made from cellulose-based substrates encapsulated with a polymeric film may replace expanded polystyrene and all other expanded polymers. The encapsulated cellulose-based substrates may replace Styrofoam in any number of consumer products, such as containers for hot and cold objects, ice chest coolers, hot or cold beverage holders, and every other product presently or that in the future may be made from an expanded polymer.

Figure 11:
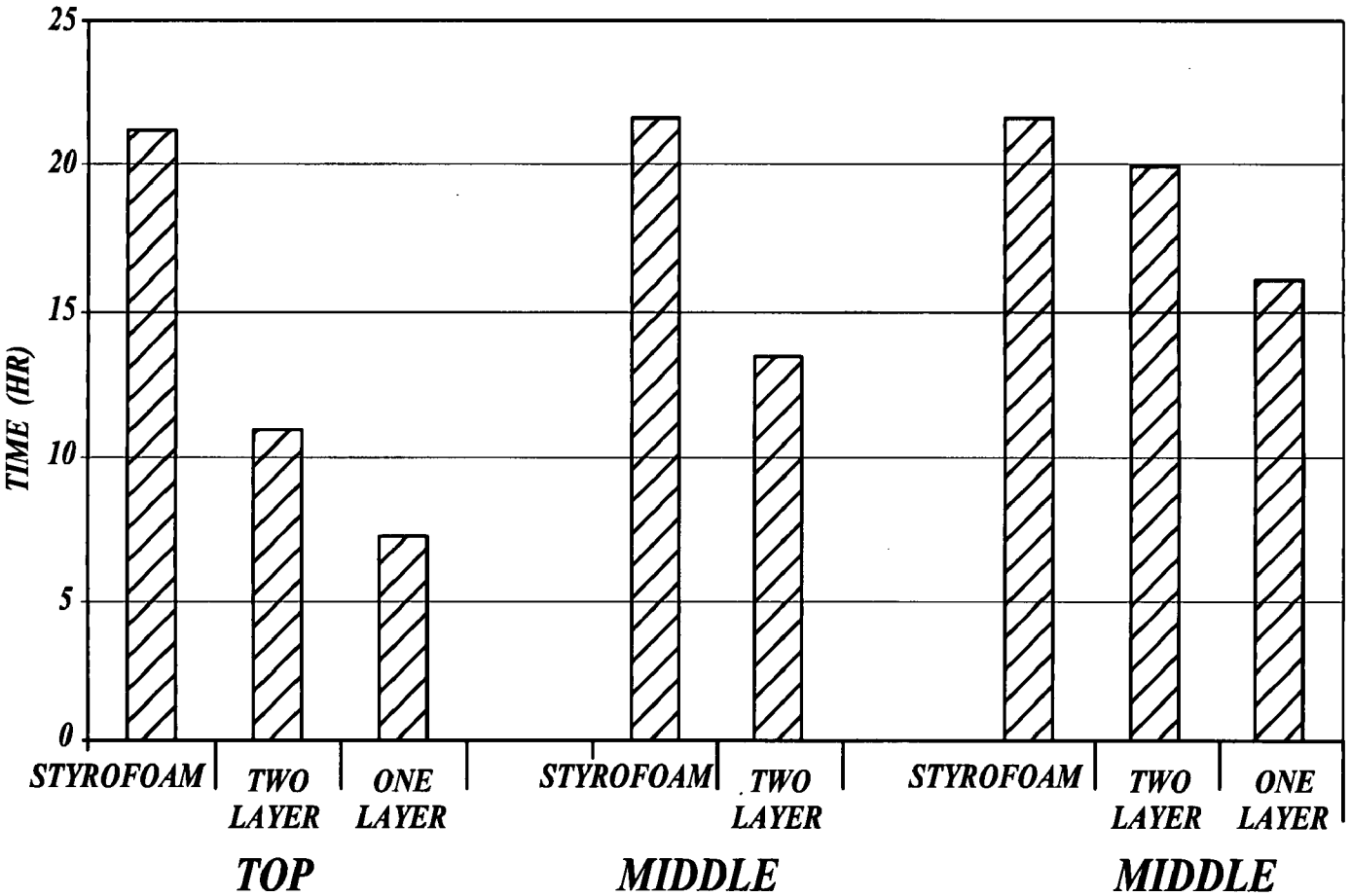
FIG. 11 is a bar graph comparing the time required for various insulating containers to reach temperatures in comparison to a Styrofoam container.

The insulating properties of representative examples of encapsulated cellulose-based substrates are charted in comparison with Styrofoam in FIG. 11. The chart illustrates the time required for a one and a two layered encapsulated cellulose-based substrate to reach the same temperature that was reached by a Styrofoam container after about 22 hours. The Styrofoam container was approximately one (1) inch thick on all sides. The Styrofoam container was compared against two containers incorporating an insulating layer made from a cellulose-based substrate encapsulated with a polymeric film. Tested cellulose-based substrate containers included a container with two inserts, as described above in connection with FIG. 2, and a container made using only a single insert. Both exterior bottom and lid of each cellulose-based substrate container was essentially the same. Both the bottom of the containers and the lid of the containers were made from C-flute singlewall fibreboard encapsulated with a polymeric film. The inserts were constructed of doublewall corrugated board encapsulated with a polymeric film. One container used two inserts, and the other container used a single insert. For ease of understanding, the container with two inserts made from a cellulose-based substrate encapsulated with a polymeric film will simply be referred to as the encapsulated two layered container. For ease of understanding, the container with one insert made from a cellulose-based substrate encapsulated with a polymeric film will simply be referred to as the encapsulated one layered container. The testing method included placing an equal amount of gel ice packs into each container made from the three respective materials, i.e., expanded polystyrene, one layered encapsulated fibreboard, two layered encapsulated fibreboard. A temperature recorder was placed at the bottom and the top in the interior of the three containers, but only at the middle interior of the Styrofoam and the encapsulated two layered containers. The gel ice packs substantially filled the containers. All three containers were subjected to an ambient temperature of about 107 to 109 degrees Fahrenheit during the testing period. The temperatures at the top, middle, and bottom of the Styrofoam container were recorded for about 22 hours. The encapsulated two layered container required about 11 hours to reach the same temperature that was recorded at 22 hours for the Styrofoam container at the top of the container, and the encapsulated one layered container required about 7 to 8 hours to reach the same temperature that was recorded at 22 hours for the Styrofoam container at the top of the container.

The encapsulated two layered container required about 13 to 14 hours to reach the same temperature that was recorded at 22 hours for the Styrofoam container at the middle of the container. The middle temperature of the encapsulated one layered container was not recorded.

The encapsulated two layered container required about 20 hours to reach the same temperature that was recorded at 22 hours for the Styrofoam container at the bottom of the container, and the encapsulated one layered container required about 16 hours to reach the same temperature that was recorded at 22 hours for the Styrofoam container at the bottom of the container.

Figure 12:
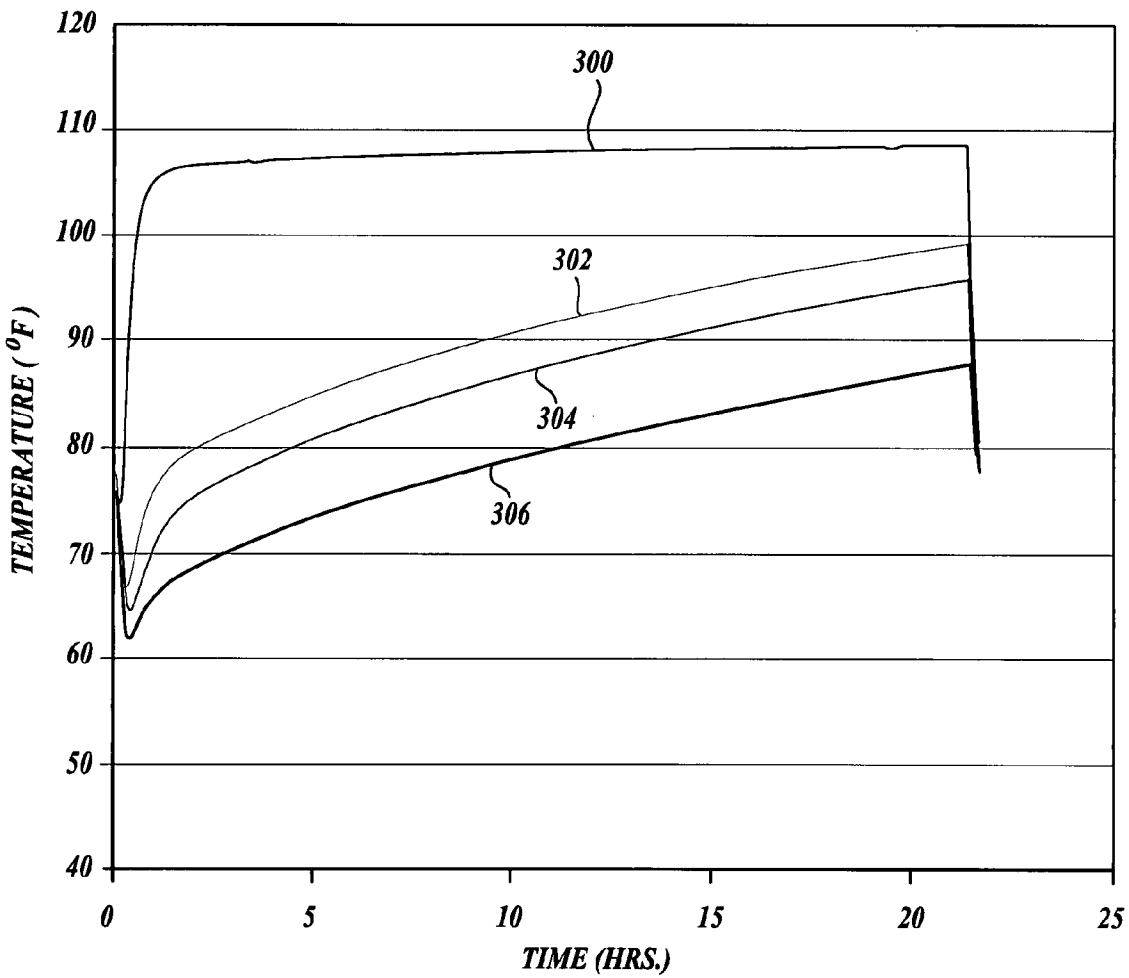
FIG. 12 is a plot of the top temperatures of various insulating containers.

Referring to FIG. 12, time versus temperature plots are shown of the ambient temperature 300, and the respective container top temperatures measured for the Styrofoam container temperature 302, the encapsulated two layered container temperature 304, and the encapsulated one layered container temperature 306.

Figure 13:
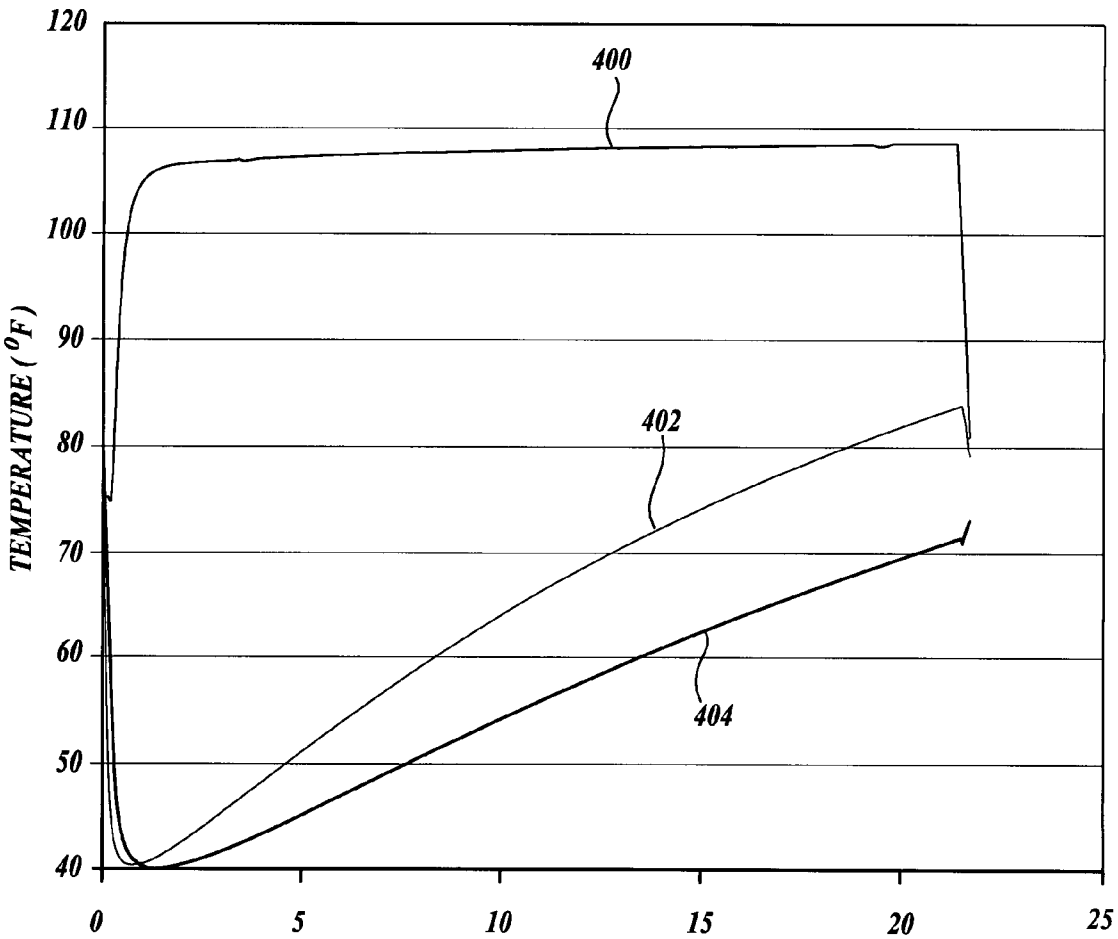
FIG. 13 is a plot of the middle temperatures of various insulating containers.

Referring to FIG. 13, time versus temperature plots are shown of the ambient temperature 400, and the middle temperatures measured for the Styrofoam container temperature 402 and the encapsulated two layered container temperature 404. The middle temperature of the encapsulated one layered container was not measured.

Figure 14:
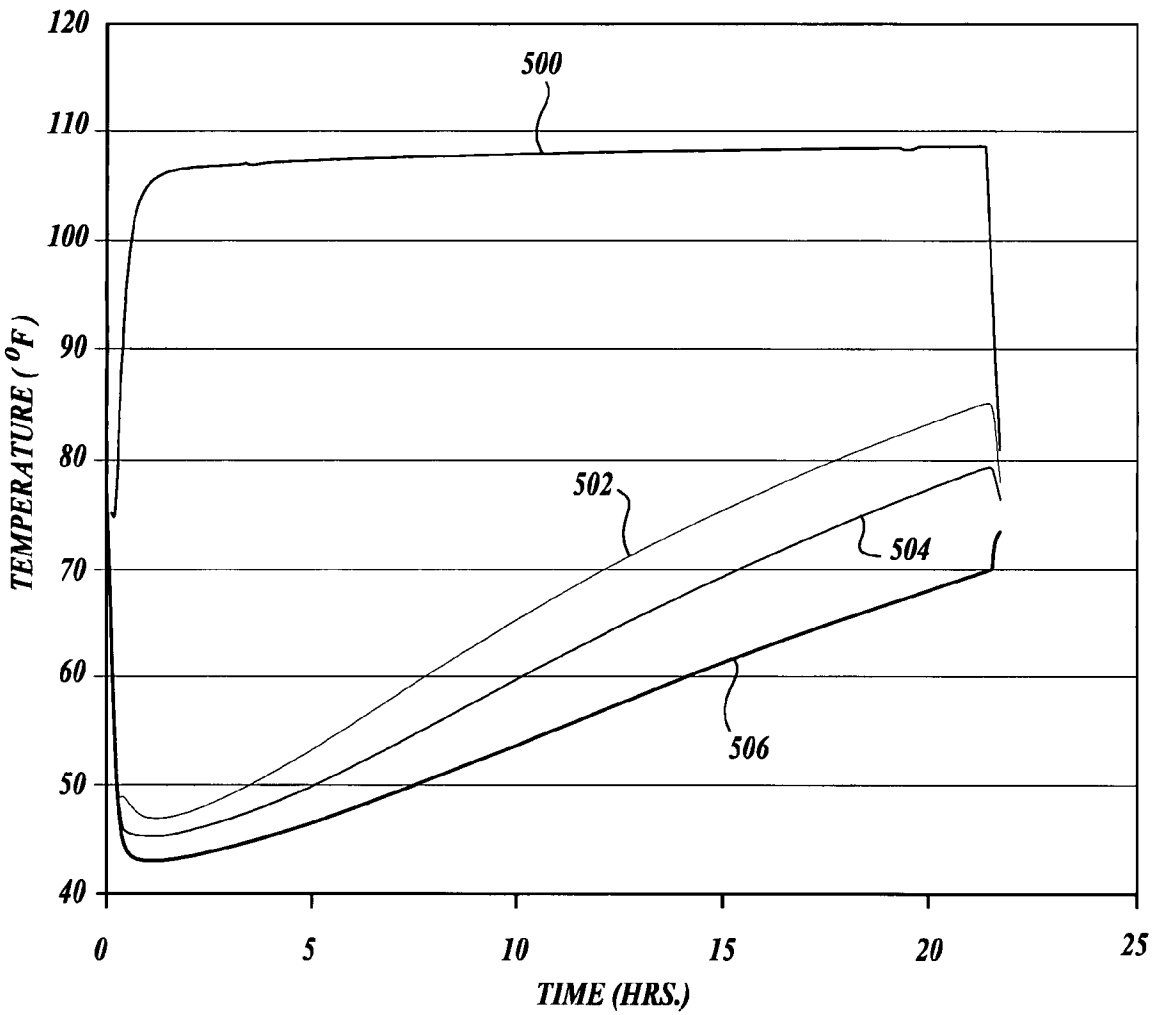
FIG. 14 is a plot of the bottom temperatures of various insulating containers.

Referring to FIG. 14, time versus temperature plots are shown of the ambient temperature 500, and the bottom temperatures measured for the Styrofoam container temperature 502, the encapsulated two layered container temperature 504, and the encapsulated one layer container temperature 506.

Therefore, as can be appreciated from the foregoing FIGURES, some containers having cellulose-based substrates encapsulated with a polymeric film provide some insulating value approaching that of expanded polystyrene. It is possible to increase the insulating capacity of the encapsulated cellulose-based substrate by including more than two encapsulated inserts. Thus, the present invention may be used to replace Styrofoam shipping containers, or any expanded polymer insulation in whatever manner of container used. Furthermore, the insulating encapsulated cellulose-based substrates may be recycled in the same recycling stream with OCC.

Methods to encapsulate a cellulose-based substrate with a polymeric film have been described in the aforementioned applications in the Background section above. An encapsulated cellulose-based substrate has all sides generally sealed by a polymeric film, so the cellulose-base substrate is rendered substantially moisture resistant. U.S. patent application Ser. No. 10/880,008 describes the encapsulation of cellulose-based substrates via a process utilizing non-electromagnetic radiation, such as resistance heating, to weld the polymeric films. U.S. patent application Ser. No. 10/879,268 describes the encapsulation of cellulose-based substrates via a process utilizing electromagnetic radiation, such as infrared, microwave, and radio frequency energy, to weld the polymeric films. U.S. patent application Ser. No. 10/879,821 describes the encapsulation of cellulose-based substrates via a process utilizing adhesives to bond the polymeric films to each other and optionally to the cellulose-based substrate. The aforementioned methods generally relied on bonding, welding or attaching two independent sheeted films on both sides of the substrate. Other equally suitable methods to encapsulate a cellulose-based substrate include processes analogous to, or the same as "shrink-wrapping." In shrink-wrapping, the object to be wrapped is surrounded within a tube of polymeric film, usually polyvinyl chloride, and the ends are then welded and trimmed closely to the wrapped object. The film is then heated which causes the polymer molecules to contract, thus, tightly surrounding the object. Heating of the shrink wrap polymeric film is usually done in a commercially available shrink wrap tunnel.

The present invention has been described above in the context of a containerboard box encapsulated with a polymeric film. As described above, the containerboard box 100 can be formed to provide a thermally insulating container by encapsulating any one of the box components in a polymer film. For example, the exterior components including the bottom or the lid may be encapsulated with a polymeric film to provide thermal insulation. Additionally, if more thermal insulating value is desired, one or more inserts made from encapsulated fibreboard may be added to the interior of the container. Furthermore, the insulating members may be single face, singlewall, doublewall, or multiwalled. Preferably, the thermally insulating layer will be have at least one corrugated medium with a substantial volume of air space that is encapsulated with a polymeric film. In addition, a thermally insulating container can be combined with other components such as inner packings that may be encapsulated with a polymeric film to further provide more insulating value. Furthermore, containers can be provided wherein the container body is not encapsulated with a polymeric film while certain inner packing components are encapsulated with a polymeric film. Alternatively, the encapsulated cellulose-based container can be combined with nonencapsulated inner packings. In addition, cellulose-based inner packings encapsulated with a polymeric film can be combined with non-cellulose based container bodies and cellulose-based container bodies encapsulated with polymeric film can be combined with non-cellulosic inner packing structural components.

EXAMPLE 1

Recyclability of Representative Encapsulated Cellulose-Based Substrates at the OCC Recycling Facility at Springfield, Oreg.

A trial was conducted at the Weyerhaeuser OCC recycling facility at Springfield, Oregon to test the recyclability of cellulose-based substrates encapsulated with a polymeric film. Encapsulated blanks were first shipped to the Kent, Wash., recycling facility where the encapsulated blanks were prepared into bales. Various trial bales containing 4%, 10%, and 20% of encapsulated blanks, with the remainder being OCC, were prepared. There were 53 bales each having 4% encapsulated boxes, 9 bales each having 10% encapsulated boxes, and 5 bales each having 20% encapsulated boxes. The bales were fed into the pulper at the Springfield facility while the plant was running at 800 tons per day. Operating parameters that were monitored included production rate, pulper motor load, detrasher motor load, Combisorter motor load, and the course and fine screens differential pressures. Visual examination of the Combisorter rejects and rotating drum screen rejects were maintained throughout the trial. Baseline samples and trial samples of the pulper discharge, Combisorter feed, and accepts and thickener samples were taken for testing. The pulper and Combisorter samples were tested for rejects. The thickener samples were tested for "stickies." As used in this application, "stickies" refers to tacky materials that come from recycled fiber sources and end up either as spots in the paper or, more likely, as deposits in felts and other transfer surfaces in the press section and dry end of a paper machine. To quantify how much of the encapsulating polymeric film was in the Combisorter rejects and rotating drum screens, several samples were taken over about five minutes, just after the last trial bales entered the pulper. The encapsulating polymeric film was a fluorescent green to make the material easy to identify. The samples were separated into green polymeric film, and other plastics. The Combisorter rejects sample contained about 9% green polymeric film with the remainder being other plastics. The sample appeared to indicate that relatively little of the encapsulating polymeric film left the pulping cycle. The rotating screen drum (detrasher rejects) samples contained about 40% green encapsulating polymeric film. Stickies were also measured on the thick stock prior to and at the end of the trial to gain information on how the hot melt adhesive used in the encapsulated blanks affects quality. Baseline samples were taken as well as during the trial. Baseline stickies count ranged from 3 to 11, while trial samples ranged from 8 to 19. On average, there was an increase in stickies during the trial. The trial samples were taken at about the time that the stock would have been at the thickener after a large spike in production rate was noticed. Therefore, it is unclear whether the encapsulated blanks or the production spike was the main contributor of the increased stickies. It is believed that both of these factors played a part in the increase in stickies count. There was no reported increase in stickies on the paper machine. The recyclability of encapsulated cellulose-base substrates was seen as a success due to various observations: The system ran at near full capacity (greater than 800 tons per day) for the duration of the trial without interruption or system upset. There was no apparent increase in fiber losses. The polymeric film retrieved from the drum screen and Combisorter was fiber free. Based on samples from the Combisorter rejects, rotating drum screen rejects, and ragger observations, the polymeric film was separated from the boxes almost entirely in the pulper. Very little of the encapsulating polymeric film made it to the core screen rejects, about 9% of the plastic in the Combisorter rejects was the fluorescent green polymeric material used as the encapsulating film. Accordingly, based on the foregoing, it is possible to place cellulose-based substrates encapsulated with a polymeric film in a recycle stream with OCC.

EXAMPLE 2

Comparison of the Interior Temperatures of Representative Encapsulated Cellulose-Based Substrates and Expanded Polystyrene Containers A trial was conducted to compare the interior temperatures of containers including insulating members made from encapsulated cellulose-based substrates, made in accordance with FIG. 2, and expanded polystyrene containers. Four boxes containing the components of FIG. 2 were prepared. The bottoms and lids of the boxes were made from C-flute singlewall fibreboard, and the first and second insert were made from doublewall BC corrugated board. This approach yielded two layers of insulating inserts at the top and at the bottom of the product. Two of the four boxes were packed with geoduck product. Each box contained one HOBO temperature recording device to measure the interior temperature of each box. Two of the four boxes were packed with oysters. Of the latter boxes, the first box had a temperature recorder taped to the lid with a probe wire leading to the outside of the box to measure the exterior temperature. One stainless steel cylinder recorder was placed in the middle of the oysters and one HOBO recorder at the bottom of the box. The second box of oysters contained one HOBO recorder at the bottom of the box.

Two Styrofoam boxes having the designation LD 34 (0.9 inch thick) were used as a control. The first Styrofoam box was packed with oysters. The first box contained one temperature recorder taped to the lid with a probe wire leading to the outside of the box to measure the exterior temperature, and also contained one stainless steel cylinder recorder placed in the middle of the oysters and one HOBO recorder at the bottom of the box. The second Styrofoam box was packed with geoduck and contained one HOBO recorder.

Figure 15:
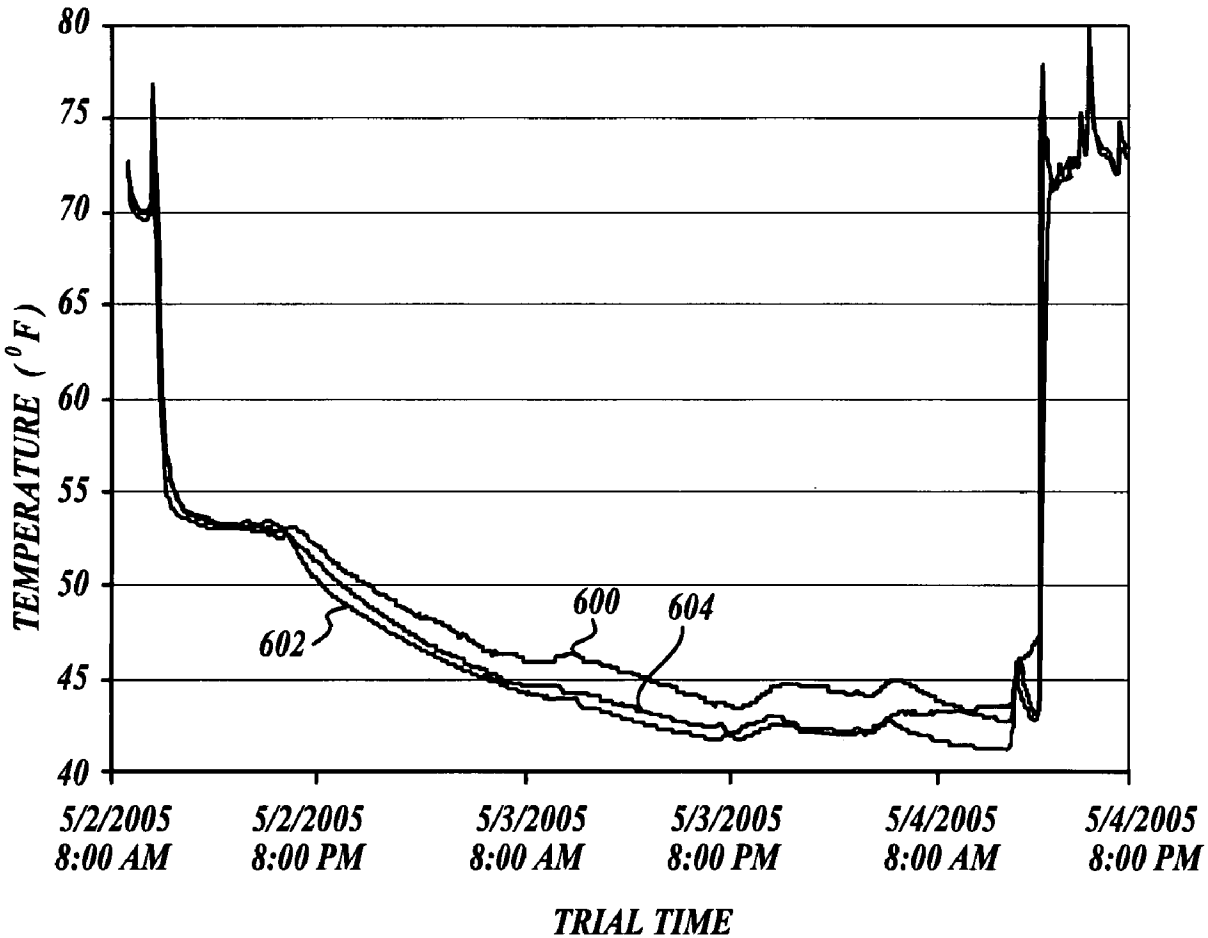
FIG. 15 is a plot of the interior temperatures of various insulating containers.
Figure 16:
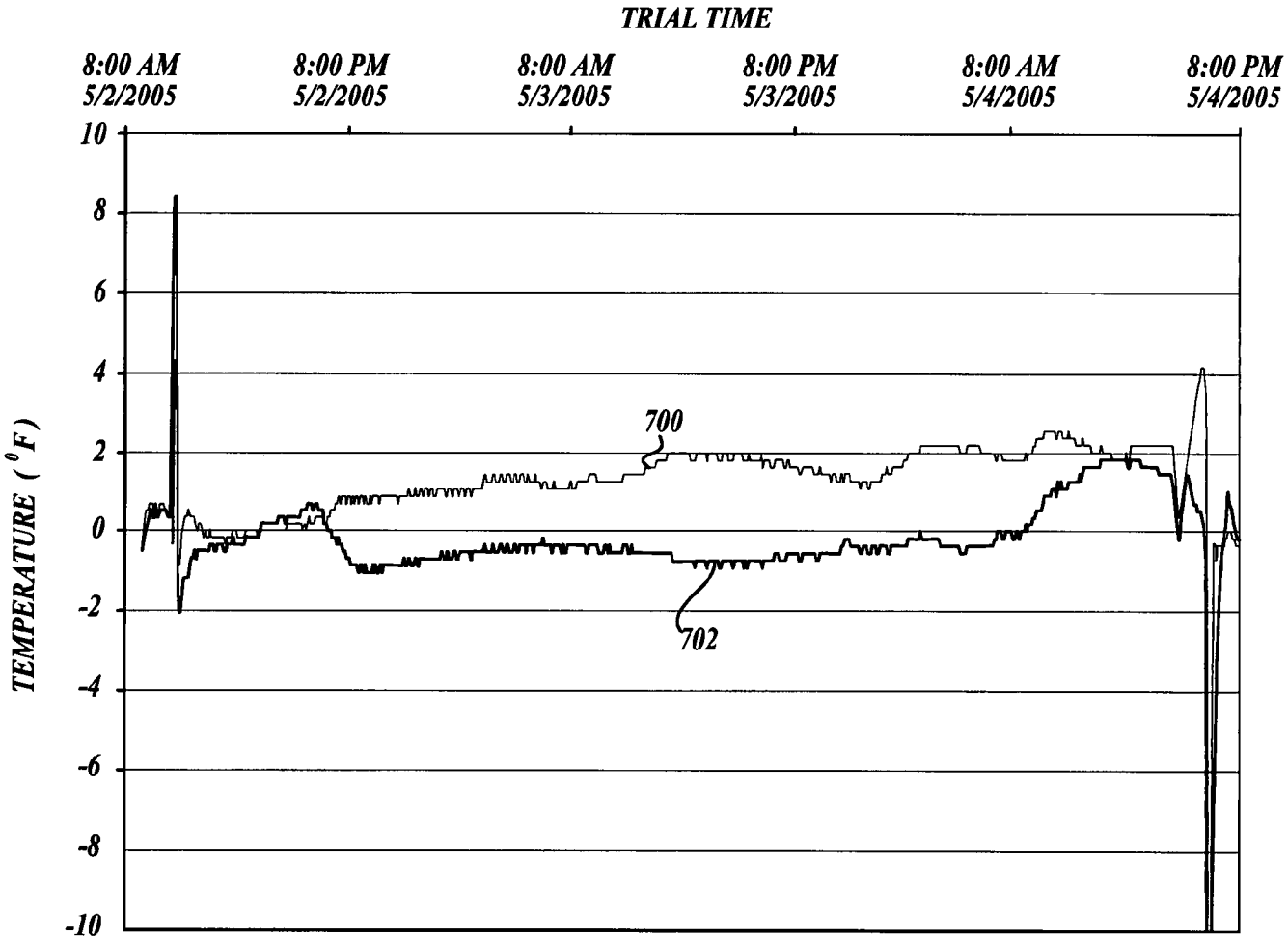
FIG. 16 is a plot of the differences in the interior temperatures of the insulating containers of FIG. 15.

All boxes were subjected to essentially the same conditions, including exterior temperatures. All boxes were loaded on an airplane bound for Hong Kong from Washington state. Upon arrival in Hong Kong, the temperature recorders were to be recovered. Due to unforeseen events, several of the temperature recording devices were lost. Enough of the recording devices were recovered to make a comparison between two of the boxes made in accordance with FIG. 2 and an expanded polystyrene box. FIG. 15 shows a plot of the interior temperatures 600, 602 of two containers of FIG. 2 and the temperature 604 of a container made of expanded polystyrene during the period from May 2, 2005 at 8:00 am to May 4, 8:00 pm. Neglecting the starting and ending spikes in temperatures, it can be readily seen that all three boxes provided about the same insulation as measured and recorded by the interior temperatures. FIG. 16 shows a plot of the difference in temperatures between each respective container made in accordance with FIG. 2 and the Styrofoam container. FIG. 16 essentially shows a ±2 degree difference in temperature between the boxes constructed in accordance with FIG. 2 and the expanded polystyrene container. According to the data, one box made in accordance with FIG. 2 provided an interior temperature that was generally greater than the interior temperature of the Styrofoam container, indicated by the plot line 700. One box made in accordance with FIG. 2 provided an interior temperature that was generally lower than the interior temperature of the Styrofoam container, indicated by the plot line 702. Accordingly, the trial indicates that containers that have insulating members made from an encapsulated cellulose-based substrate may provide adequate insulation comparable to containers made from expanded polystyrene.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An insulated container comprising:

an exterior container component comprising a bottom panel, first and second opposed pairs of upstanding side walls and a cover member; and a first thermally insulating member within the exterior container component, the first insulating member having a bottom panel, opposed side panels and top panels, the opposed side panels of the first insulating member being aligned with the first opposed pair of side walls of the exterior container component wherein the bottom panel being integrally attached to the opposed side panels and the top panels being integrally attached to the opposed side panels, a second thermally insulating member within the first thermally insulating member, the second insulating member having a bottom panel, opposed side panels and top panels, the opposed side panels of the second insulating member being aligned with the second opposed pair of side walls of the exterior container component wherein the bottom panel being integrally attached to the opposed side panels and the top panels being integrally attached to the opposed side panels, the thermally insulating members being cellulose-based corrugated material encapsulated with a polymeric film, and wherein air is trapped within the corrugated material by the polymeric film.

2. The container of claim 1, wherein the insulating members volume comprises mostly air.

3. The container of claim 1, wherein the insulating members are substantially moisture resistant and substantially hermetically sealed.

4. The container of claim 1 wherein at least one of the insulating members is single wall corrugated material.

5. The container of claim 1 wherein at least one of the insulating members is double wall corrugated.

6. The container of claim 1 wherein the coyer member of the exterior container component is a separate lid.

7. The container of claim 1 wherein the cover member of the exterior container component is cover panels hingedly attached to the side walls.

* * * * *